US006862744B2

(12) United States Patent
Kuroda et al.

(10) Patent No.: US 6,862,744 B2
(45) Date of Patent: Mar. 8, 2005

(54) ATHLETIC GLOVE

(75) Inventors: Shigeki Kuroda, Osaka (JP); Kazuhiro Kume, Osaka (JP); Satoshi Yoshida, Osaka (JP); Konosuke Nishijima, Osaka (JP); Soichi Fujimoto, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/143,472

(22) Filed: May 10, 2002

(65) Prior Publication Data

US 2002/0152536 A1 Oct. 24, 2002

Related U.S. Application Data

(62) Division of application No. 09/736,848, filed on Dec. 12, 2000, now Pat. No. 6,405,380.

(30) Foreign Application Priority Data

Aug. 29, 2000 (JP) ..... 2000-258772

(51) Int. Cl.[7] ..... A63B 71/14
(52) U.S. Cl. ..... 2/161.1; 2/161.2
(58) Field of Search ..... 2/161.1, 161.2, 2/163, 159, 167, 168, 19

(56) References Cited

U.S. PATENT DOCUMENTS

| | | | | |
|---|---|---|---|---|
| 4,146,935 A | | 4/1979 | Hinton | |
| RE31,538 E | * | 3/1984 | Antonious | 2/161.2 |
| 4,864,660 A | * | 9/1989 | Sawyer | 2/161.1 |
| 5,175,886 A | * | 1/1993 | Suk | 2/161.2 |
| 5,195,188 A | | 3/1993 | Bourdeau et al. | 2/161 A |
| 5,197,149 A | | 3/1993 | Overton | 2/161 A |
| 5,423,089 A | | 6/1995 | Chun et al. | 2/161.2 |
| 5,435,013 A | | 7/1995 | Davis | 2/161.1 |
| 5,511,247 A | | 4/1996 | Block | 2/161.1 |
| 5,669,073 A | | 9/1997 | Pellington | 2/161.2 |
| 5,704,065 A | | 1/1998 | Feuerhake | 2/161.2 |
| 5,708,979 A | | 1/1998 | Redwood et al. | 2/161.1 |
| 5,740,555 A | | 4/1998 | Renegar | 2/161.2 |
| 5,742,942 A | | 4/1998 | Sykes | 2/161.4 |
| 5,758,365 A | | 6/1998 | Steeley | 2/161.1 |
| 5,893,172 A | | 4/1999 | Haynes et al. | 2/161.2 |

FOREIGN PATENT DOCUMENTS

| | | | |
|---|---|---|---|
| EP | 654 227 | 5/1995 | |
| EP | 1 064 971 | 1/2001 | |
| JP | 57-121615 | 7/1982 | A41D/19/00 |
| JP | 60-76966 | 5/1985 | A63B/71/14 |
| JP | 11-57107 | 3/1999 | A63B/71/14 |
| JP | 2000037496 | 8/2000 | |
| WO | WO 00/41777 | 7/2000 | |

OTHER PUBLICATIONS

European Search Report dated Nov. 9, 2001.

* cited by examiner

*Primary Examiner*—Rodney M. Lindsey
(74) *Attorney, Agent, or Firm*—Troutman Sanders LLP; Gerald R. Boss

(57) ABSTRACT

An athletic glove comprises a back portion and a palm portion. A tape is stitched to the back portion. The tape extends from a little finger portion, a ring finger portion and a middle finger portion toward the base of a thumb portion, and can supply proper fastening force to the little finger, the ring finger and the middle finger of the user's hand when the user grasps an object.

10 Claims, 11 Drawing Sheets

ATHLETIC GLOVE

RELATED APPLICATIONS

This application claims priority based on Japanese Patent Application No. 2000-258772(P) filed Aug. 29, 2000 and entitled "Athletic Glove," and is a divisional application of U.S. Ser. No. 09/736,848 filed Dec. 12, 2000, now U.S. Pat. No. 6,405,380 and entitled "Athletic Glove."

BACKGROUND OF THE INVENTION

1. Field of the Invention

The present invention relates to an athletic glove, and more specifically, it relates to an athletic glove employed in athletic sports for grasping a sphere or a rod.

2. Description of the Prior Art

In an athletic glove employed in athletic sports for grasping a sphere or a rod, a relatively thick material is generally applied to a palm portion in order to protect the hand of the user. However, the material for the palm portion is generally inferior in elasticity. If the overall athletic glove is made of such a material, therefore, fittingness to the hand is remarkably deteriorated. Therefore, a material having excellent elasticity (hereinafter simply referred to as "elastic material") or the like is arranged on a back portion of the athletic glove.

For example, Japanese Patent Laying-Open No. 11-57107 (1999) describes an exemplary athletic glove including an elastic material arranged on a back portion. The athletic glove described in this literature is prepared by coupling a back portion formed by stitching a plurality of non-elastic materials to a single elastic material with a palm portion.

When the user wearing the athletic glove grips the handle of a bat, for example, the elastic material forming the back portion stretches to improve fittingness to the user's hand.

When the user grasps an object in athletic sports in practice, the back portion may excessively stretch to slacken or crease the palm portion. The slackened or creased palm portion hinders the user's play and reduces his ability.

In this case, further, the user cannot grip the object as imaged but needs extra power for the grip, and strains too much to make a subtle and delicate motion.

SUMMARY OF THE INVENTION

Prior U.S. Ser. No. 09/736,848 application filed Dec. 12, 2000 is hereby incorporated herein by reference.

The present invention has been proposed in order to solve the aforementioned problems. An object of the present invention is to provide an athletic glove improved in fittingness to the user's hand by inhibiting a palm portion from slackening or creasing when the user grasps an object while attaining proper strain when the user grasps the object so that the user can grasp the object in a relaxed state with no extra power.

According to an aspect of the present invention, an athletic glove comprises a back portion covering the back of the user's hand and is worn for grasping an object, while the back portion is provided with a tape extending along a direction from the proximal phalanx of at least one of the little finger, the ring (third) finger and the middle finger of the user's hand toward the metacarpal bone of the index finger.

When the user grasps the object with the athletic glove, therefore, the tape fastens at least one of the little finger, the ring finger and the middle finger. Thus, the user can firmly grasp the object with the little finger, the ring finger and the middle finger rather than with the thumb or the index finger. Further, the aforementioned tape can also inhibit palm portion from slackening or creasing.

A little finger portion, a ring finger portion and a middle finger portion of the back portion preferably include a first material portion having first elasticity and a second material portion having second elasticity higher than the first elasticity. In this case, the tape may be made of a third material having third elasticity higher than the first elasticity and lower than the second elasticity, or made of the first material or the second material.

In any case, the athletic glove can supply proper fastening force to at least one of the little finger, the ring finger and the middle finger, so that the user can reliably grasp the object with the little finger, the ring finger and the middle finger.

The tape preferably extends along a direction from the proximal phalanxes of the little finger, the ring finger and the middle finger toward the metacarpal bone of the index finger.

Further, the tape preferably curvedly extends from the vicinity of the metacarpophalangeal joints of the little finger, the ring finger and the middle finger toward the metacarpal bone of the thumb. Thus, the athletic glove can effectively supply fastening force to at least one of the little finger, the ring finger and the middle finger when the user grasps the object.

In an athletic glove according to another aspect of the present invention, the back portion is provided with a bending resistance portion increasing the bending resistance of at least one of the little finger, the ring finger and the middle finger of the user's hand beyond the bending resistance of the index finger thereby increasing the ratio of grasping power for the object with the little finger, the ring finger and the middle finger with respect to grasping power for the object with the overall palm.

The bending resistance of at least one of the little finger, the ring finger and the middle finger can be increased beyond that of the index finger by providing the bending resistance portion as described above, so that the athletic glove can consequently supply proper fastening force to at least one of the little finger, the ring finger and the middle finger when the user grasps the object. Thus, the user can firmly grasp the object with the little finger, the ring finger and the middle finger rather than with the thumb or the index finger and keep the grasping power for the object with the little finger, the ring finger and the middle finger while reducing grasping power for the object with the overall palm. Consequently, the ratio of the grasping power for the object with the little finger, the ring finger and the middle finger can be increased with respect to the grasping power for the object with the overall palm. Further, the aforementioned bending resistance portion can also inhibit the palm portion of the athletic glove from slackening or creasing.

The bending resistance portion is preferably provided on a portion covering the proximal phalanx of at least one of the little finger, the ring finger and the middle finger.

The back portion may have an elastic portion made of elastic cloth, and the bending resistance portion may be provided to overlap with the elastic portion.

The bending resistance portion may be provided on a portion covering the metacarpophalangeal joint of at least one of the little finger, the ring finger and the middle finger, may be provided to extend along a direction from the second interphalangeal joint of at least one of the little finger, the ring finger and the middle finger toward the metacarpal bone of the index finger, may be provided to extend along a direction from the middle phalanx of at least one of the little finger, the ring finger and the middle finger toward the metacarpal bone of the index finger, or may be provided to extend along a direction from the distal phalanx of at least one of the little finger, the ring finger and the middle finger toward the metacarpal bone of the index finger.

In any of the aforementioned cases, the athletic glove can supply proper fastening force to at least one of the little finger, the ring finger and the middle finger when the user grasps an object, so that the user can firmly grasp the object with the little finger, the ring finger and the middle finger rather than with the thumb or the index finger.

A little finger portion, a ring finger portion and a middle finger portion of the back portion may include a first material portion having first elasticity and a second material portion having second elasticity higher than said first elasticity. In this case, the bending resistance portion may be made of a third material having third elasticity higher than the first elasticity and lower than the second elasticity, or may be made of the first material or the second material.

The bending resistance portion is preferably stitched, bonded, thermocompression-bonded or heat-sealed to the back portion. The bending resistance portion may be formed by a tape and a resin portion.

The aforementioned athletic glove is preferably a baseball glove. More specifically, the glove is worn for batting.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to FIGS. 1 to 9.

(First Embodiment)

Figure 1:
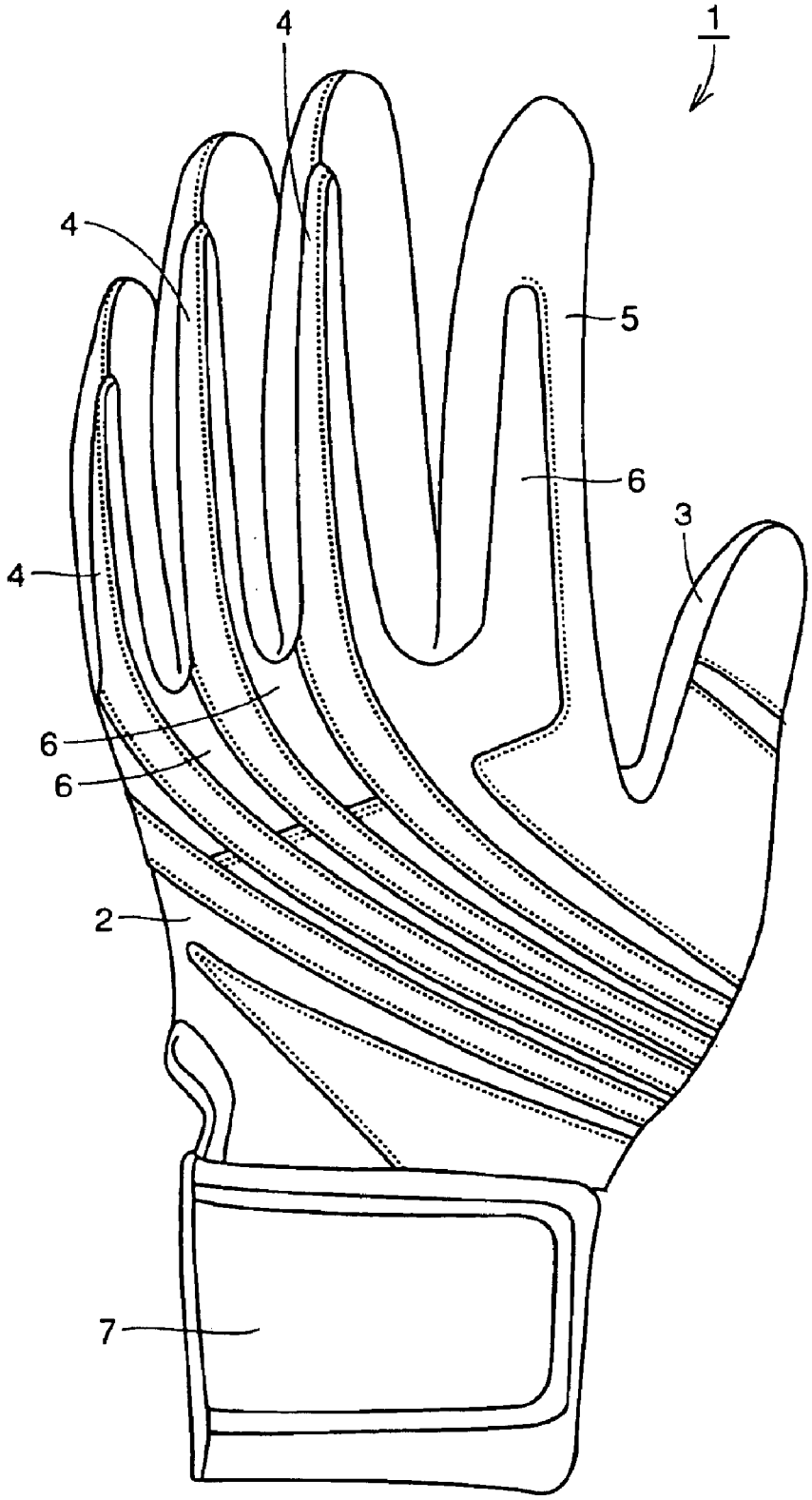
FIGS. 1 to 7 show athletic gloves according to first to seventh embodiments of the present invention as viewed from the side for covering the back of the user's hand.

FIG. 1 illustrates an athletic glove 1 according to a first embodiment of the present invention as viewed from the side for covering the back of the user's hand. This athletic glove 1, a baseball glove, is worn for batting.

As shown in FIG. 1, the athletic glove 1 comprises a back portion 2 covering the back of the user's hand, a palm portion 3 covering the palm and a belt 7.

Figure 8:
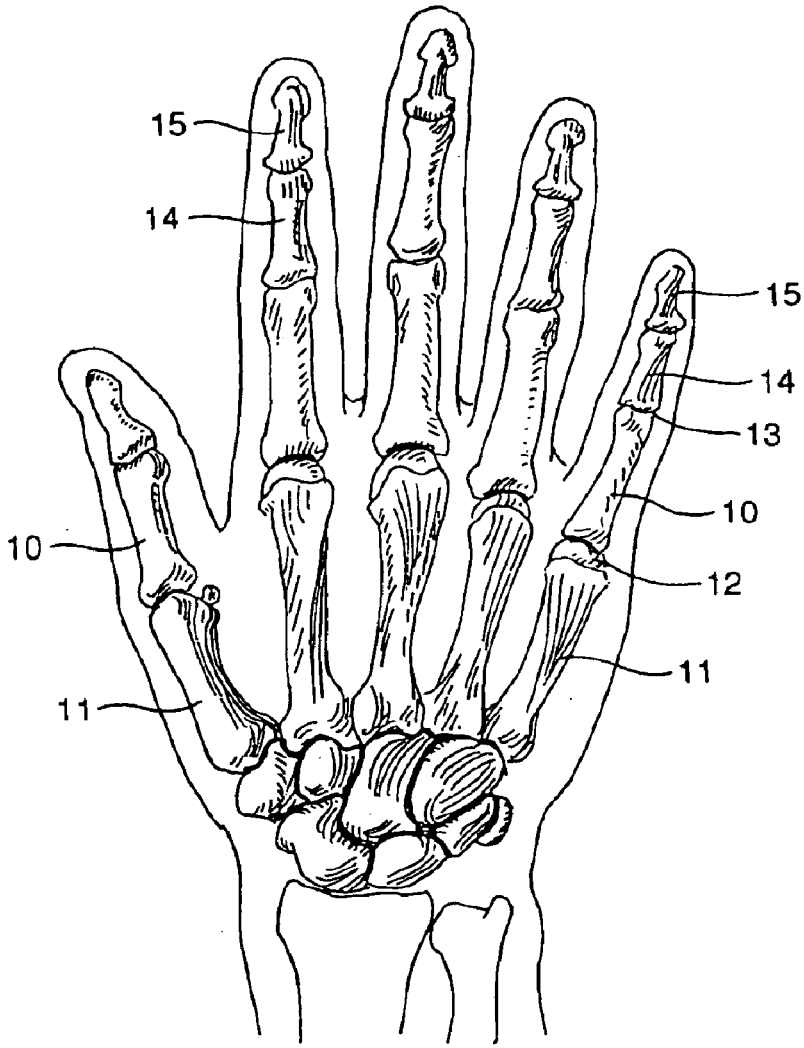
FIG. 8 illustrates the skeleton of a human hand.

Tapes 4 extending along a direction from the proximal phalanxes 10 of the little finger (fourth finger), the ring finger (third finger) and the middle finger (second finger) of the user's hand shown in FIG. 8 toward the metacarpal bone 11 of the thumb or the index finger (first finger) are stitched to the back portion 2. In other words, the tapes 4 are provided to connect a little finger portion, a ring finger portion and a middle finger portion of the back portion 2 with a portion close to the base of a thumb portion.

When the user grasps (e.g. grips) an object, the tapes 4 provided in the aforementioned manner fasten the little finger, the ring finger and the middle finger. In other words, the little finger, the ring finger and the middle finger are fixed to the object in a bent state. Thus, the user can firmly grasp the object with the little finger, the ring finger and the middle finger rather than with the thumb or the index finger.

The aforementioned tapes 4 can also inhibit the palm portion 3 from slackening or creasing, whereby the user can grasp the object as imaged for making a subtle and delicate motion.

The little finger portion, the ring finger portion and the middle finger portion of the back portion 2 preferably include a first material portion 5 having first elasticity and second material portions 6 having second elasticity higher than the first elasticity.

The first material portion 5 can be made of natural leather, for example, the second material portions 6 can be made of two-way tricot, a knit material, for example.

The tapes 4 may be made of a material having third elasticity higher than the first elasticity and lower than the second elasticity, or may be made of the first material or the second material.

The tapes 4 can be made of natural leather, synthetic leather, artificial leather, a knit material, urethane, silicon rubber or rubber, for example. The tapes 4 can supply proper fastening force to the little finger, the ring finger and the middle finger by properly selecting the material therefor.

Figure 11:
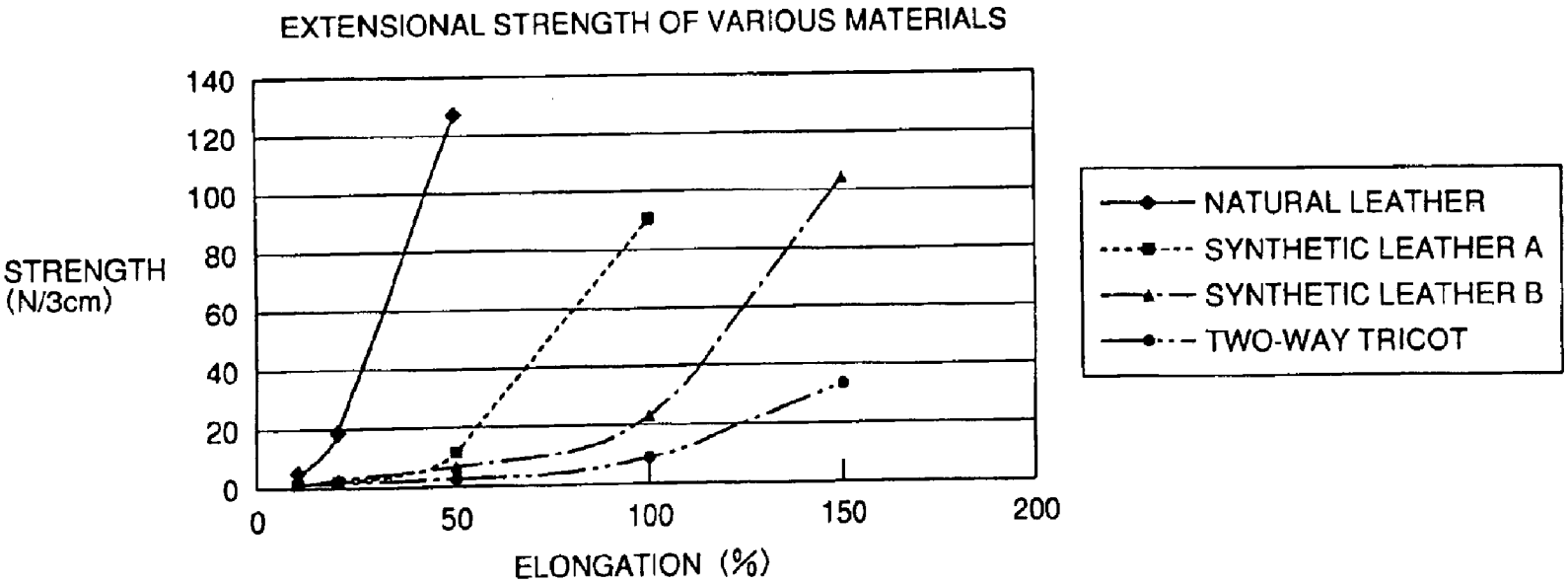
FIG. 11 illustrates extensional strength of various materials.

Extensional strength indexing the elasticity of various materials is now described. FIG. 11 shows the values of extensional strength of the materials.

It is understood from FIG. 11 that the extensional strength is reduced in order of natural leather, synthetic leather A, synthetic leather B and a knit material (two-way tricot). In other words, elasticity is increased in order of the natural leather, the synthetic leather A, the synthetic leather B and the knit material (two-way tricot). Such materials having different elasticity are properly selected as the materials for the first material portion 5, the second material portions 6 and the tapes 4, for example.

The tapes 4 are stitched to the back portion 2 to overlap with the second material portions 6, and curvedly extend along a direction from the metacarpophalangeal joints 12 of the little finger, the ring finger and the middle finger shown in FIG. 8 toward the metacarpal bone 11 of the thumb or the index finger.

When the aforementioned tapes 4 are mounted on the back portion 2, the bending resistance of at least one of the little finger, the ring finger and the middle finger exceeds that of the index finger. In other words, the tapes 4 function as bending resistance portions.

In order to confirm the effect of the tapes 4 to be the bending resistance portions, the inventor has made the following experiment.

In this experiment, a glove scan system by Nitta Kabushiki Kaisha was utilized and a pressure sensor was bonded to the glove for letting a subject to swing a baseball bat toward rubber for tee batting and measuring impact pressure applied to the subject's hand. The subject, a right-handed batter, wore the athletic glove 1 on his left hand for the experiment.

Figure 9:
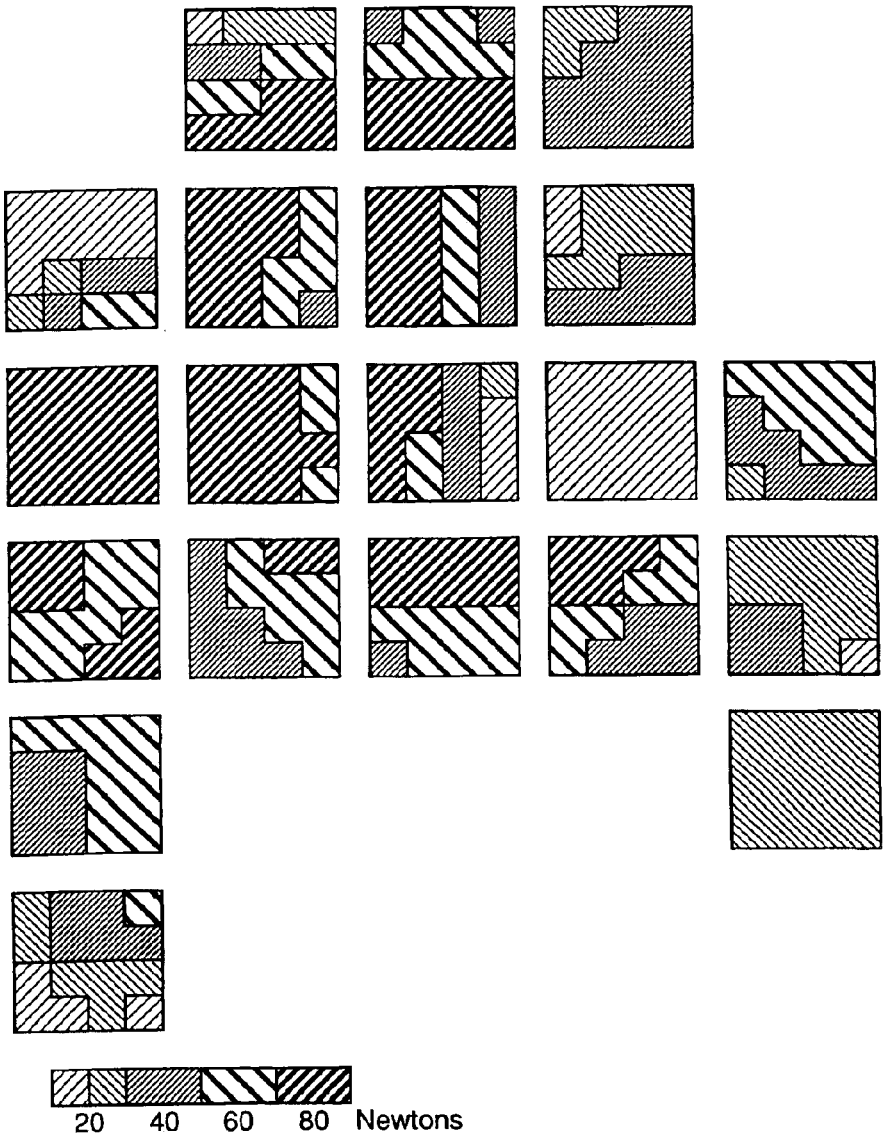
FIG. 9 illustrates experimental results of an inventive sample.
Figure 10:
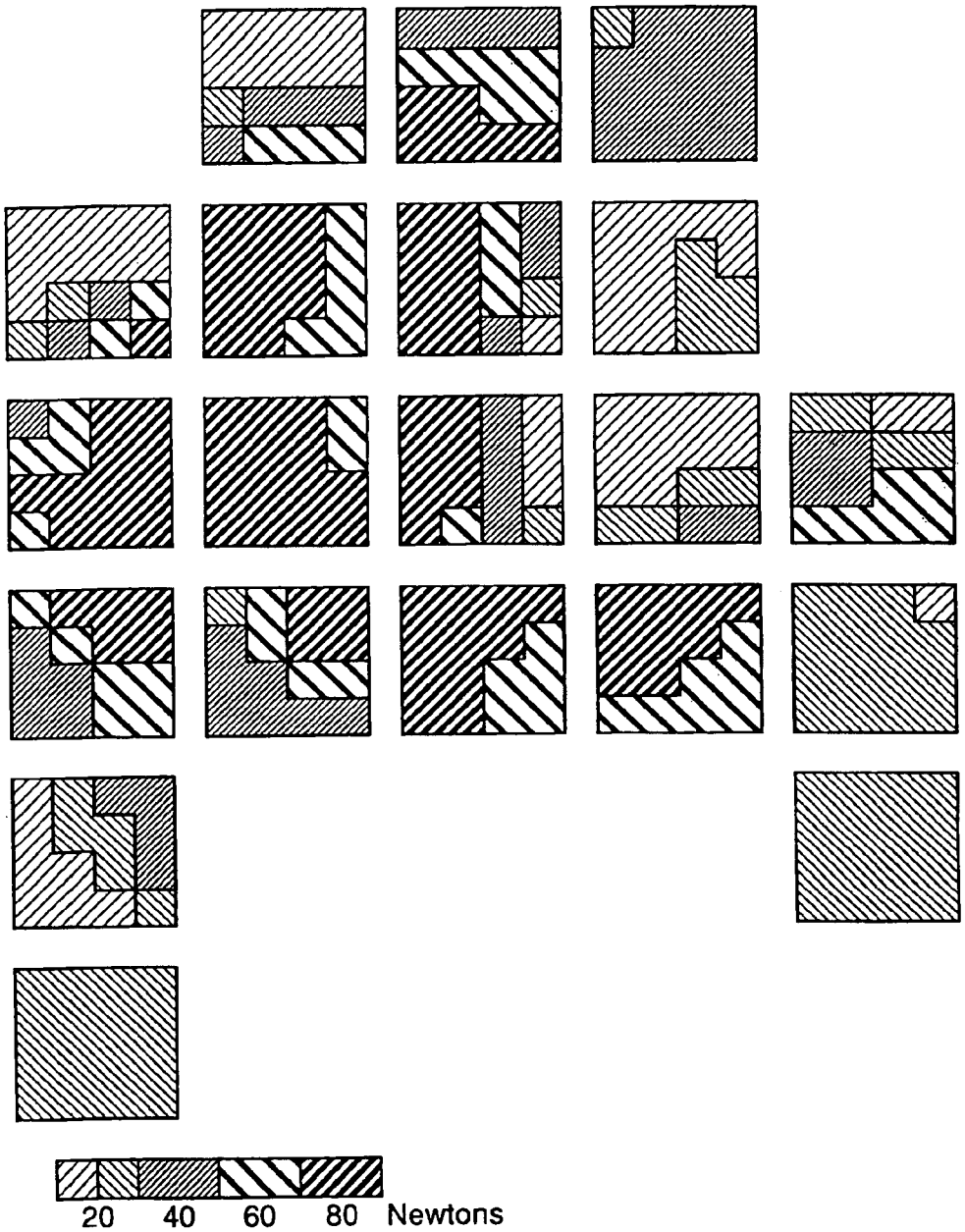
FIG. 10 PRIOR ART
FIG. 10 illustrates experimental results of a conventional sample.

FIGS. 9 and 10 show the results of the experiment on inventive and conventional samples.

First, how to observe these figures is described. Each of FIGS. 9 and 10 shows data on the thumb, the index finger, the middle finger, the ring finger and the little finger of the left hand from right to left, while showing data on the portions located between the palm and the tips of the thumb and the fingers from bottom to top.

More specifically, the plurality of vertically arranged squares appearing in five lines in each figure express force applied from the tips to the bases of the thumb and the fingers respectively. In other words, the plurality of squares in five lines may be regarded as corresponding to the thumb and the fingers of the left hand directing the palm downward. Each of FIGS. 9 and 10 shows the force applied to the cushions of the thumb and the fingers with various types of shading and lines. Large force is applied to dark portions, while small force is applied to thin transverse lines.

Comparing FIGS. 9 and 10 with each other, it is understood that larger force is applied to the little finger in the inventive sample as compared with the conventional sample. It is also understood that the force applied to the index finger is reduced in the inventive sample as compared with the conventional sample.

Table 1 shows numerical data obtained in this experiment with average values of data obtained from a plurality of subjects.

TABLE 1

| | Overall Palm | | Three Main Fingers | | Ratio of Three Main Fingers to Overall Palm | |
|---|---|---|---|---|---|---|
| | Inventive Sample | Conventional Sample | Inventive Sample | Conventional Sample | Inventive Sample | Conventional Sample |
| Average | 262 | 280 | 208 | 209 | 79% | 75% |

While the force applied to the overall palm is smaller in the inventive sample as compared with the conventional sample, the force applied to the middle finger, the ring finger and the little finger (three main fingers) important for batting is equivalent, as shown in Table 1. Therefore, the ratio of the force applied to the three main fingers to that applied to the overall palm is higher in the inventive sample as compared with the conventional sample.

Thus, it is conceivable that the thumb and the index finger are relaxed not to result in "straining" and the user can concentrate his attention on the middle finger, the ring finger and the little finger.

The aforementioned tapes 4 may be mounted at least one of the little finger portion, the ring finger portion and the middle finger portion of the back portion 2. The tapes 4 may be provided to extend along a direction from the second interphalangeal joint 12 of at least one of the little finger, the ring finger and the middle finger toward the metacarpal bone 11 of the thumb or the index finger, may be provided to extend along a direction from the middle phalanx 14 of at least one of the little finger, the ring finger and the middle finger toward the metacarpal bone 11 of the thumb or the index finger, or may be provided to extend along a direction from the distal phalanx 15 of at least one of the little finger, the ring finger and the middle finger toward the metacarpal bone 11 of the thumb or the index finger.

(Second Embodiment)

Figure 2:
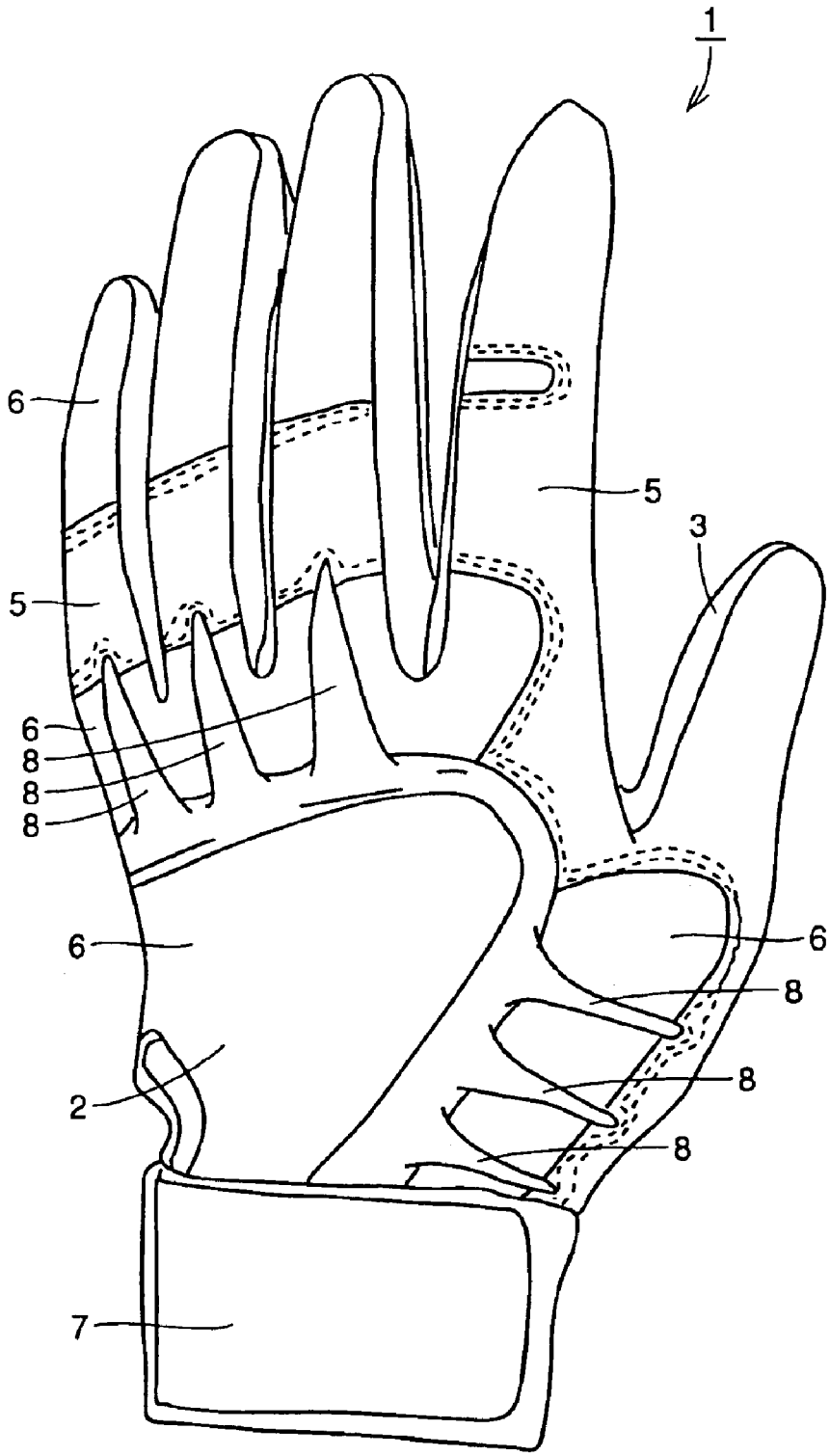

A second embodiment of the present invention is now described with reference to FIG. 2. FIG. 2 illustrates an athletic glove 1 according to the second embodiment of the present invention as viewed from the side for covering the back of the user's hand.

As shown in FIG. 2, the ratio of first material portions 5 having relatively low elasticity is reduced and the ratio of second material portions 6 having relatively high elasticity is increased in this embodiment. Resin portions 8 are provided for serving as bending resistance portions.

The resin portions 8 have a plurality of potions mounted on a back portion 2 covering regions between the proximal phalanxes 10 and the metacarpophalangeal joints 12 of the little finger, the ring finger and the middle finger of the user's hand and integrated with portions close to the metacarpophalangeal joints 12 to extend along a direction from the little finger toward the thumb, extending toward the wrist along the metacarpal bone 11 of the index finger and branched to further extend toward the metacarpal bone 11 of the thumb.

The resin portions 8 are made of urethane, silicon rubber or rubber, for example, and bonded, thermocompression-bonded or heat-sealed to the back portion 2.

The aforementioned resin portions 8 can consequently connect a little finger portion, a ring finger portion and a middle finger portion of the back portion 2 to a portion located around the base of a thumb portion, whereby an effect similar to that of the first embodiment can be expected.

(Third Embodiment)

Figure 3:
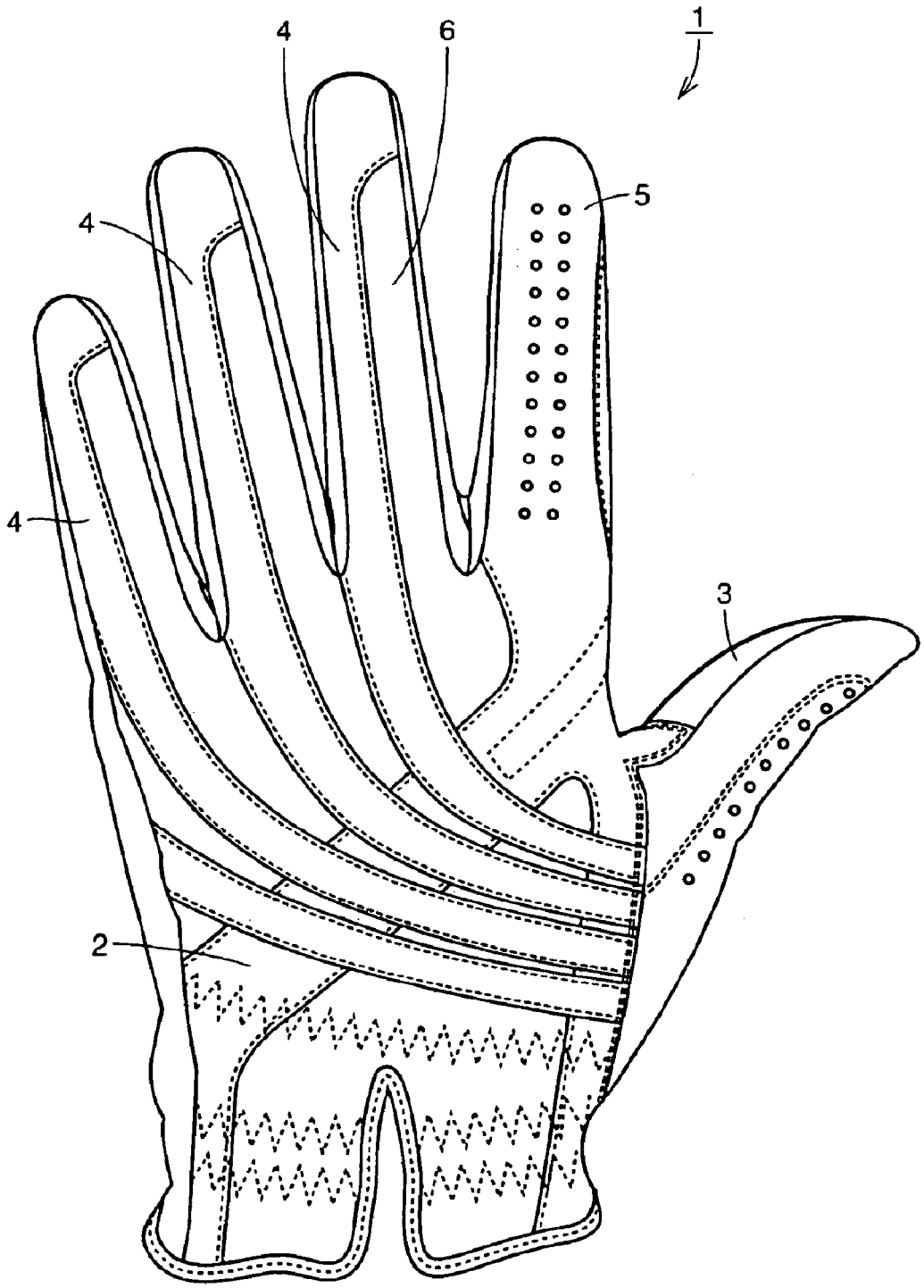

A third embodiment of the present invention is now described with reference to FIG. 3. FIG. 3 illustrates an athletic glove 1 according to the third embodiment of the present invention as viewed from the side for covering the back of the user's hand.

This embodiment applies the present invention to a golf glove. As shown in FIG. 3, tapes 4 are stitched to a back portion 2 to extend from the tips of a little finger portion, a ring finger potion and a middle finger portion of the back portion 2 to a portion around the base of a thumb portion.

When the user wearing the athletic glove 1 grasps the grip of a golf club, the athletic glove 1 can supply fastening force to the little finger, the ring finger and the middle finger of the user's hand due to the tapes 4 mounted on the back portion 2 as described above. Thus, an effect similar to that of the first embodiment can be expected.

Further, a first material portion 5 is provided to extend from under the base of the little finger portion toward a region between an index finger portion and a thumb portion and intersect with the tapes 4 on the back of the user's hand. Thus, a palm portion of the athletic glove 1 can be inhibited from creasing or slackening.

According to this embodiment, the tapes 4 are made of synthetic leather or artificial leather, for example, the first material portion 5 is made of natural leather, synthetic leather or artificial leather, for example, and second material portions 6 are made of synthetic leather or a knit material, for example.

(Fourth Embodiment)

Figure 4:
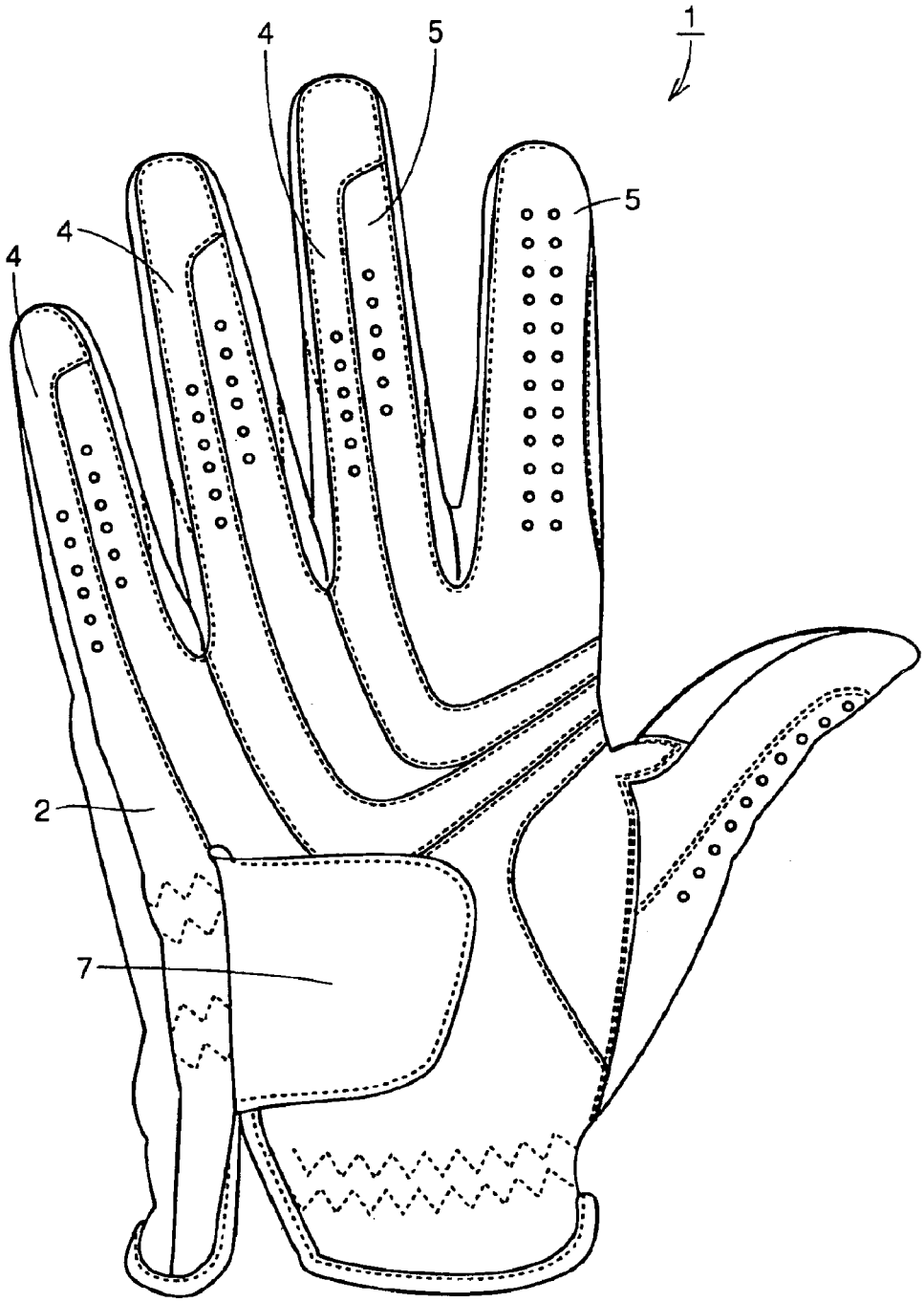

A fourth embodiment of the present invention is now described with reference to FIG. 4. FIG. 4 illustrates an athletic glove 1 according to the fourth embodiment of the present invention as viewed from the side for covering the back of the user's hand.

The athletic glove 1 according to this embodiment is also a golf glove. According to this embodiment, tapes 4 are provided to extend from the tips of a ring finger portion and a middle finger portion toward the metacarpal bone of the index finger of the user's hand and to further extend toward a region between an index finger portion and a thumb portion. Still another tape 4 is stitched to a little finger portion to extend toward the wrist of the user's hand and connected to the base of a thumb portion through a belt 7.

Thus, when the user grasps an object, the athletic glove 1 can supply proper fastening force to the little finger, the ring finger and the middle finger of the use's hand while inhibiting a palm portion from creasing or slackening.

(Fifth Embodiment)

Figure 5:
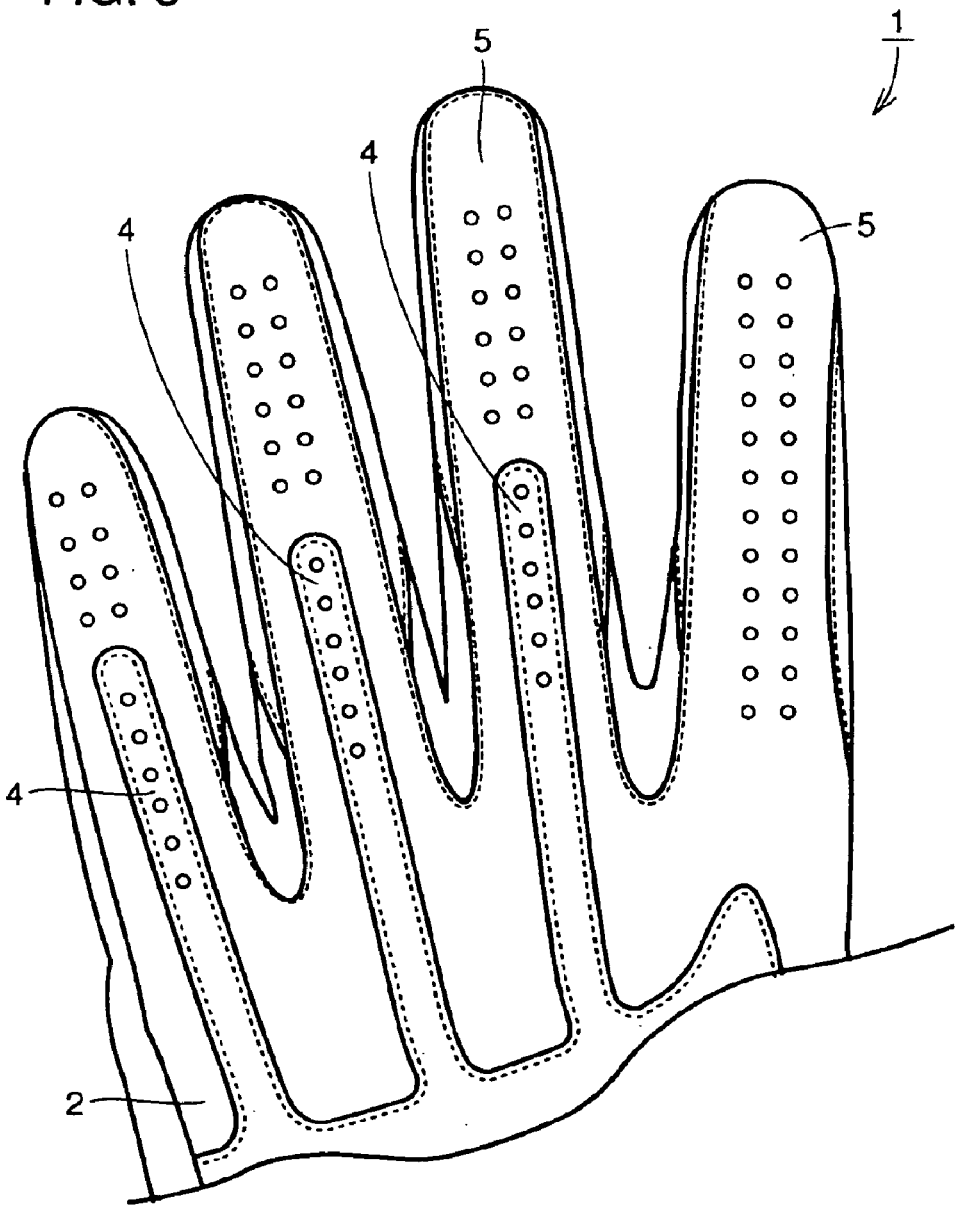

A fifth embodiment of the present invention is now described with reference to FIG. 5. FIG. 5 illustrates an athletic glove 1 according to the fifth embodiment of the present invention as viewed from the side for covering the back of the user's hand.

Each of this embodiment and subsequent embodiments is described with reference to a modification of the shape of the tapes (bending resistance portions) 4.

According to this embodiment, the tapes 4 are provided on portions covering the proximal phalanx of at least one of the little finger, the ring finger and the middle finger of the user's hand. In the embodiment shown in FIG. 5, the tapes 4 are provided on portions covering the proximal phalanxes 10 of the little finger, the ring finger and the middle finger.

One ends of the tapes 4 are connected with each other as shown in FIG. 5, and the connected portions are connected with a portion around the base of a thumb portion (not shown). A little finger portion, a ring finger portion and a middle finger portion of a back portion 2 are connected with the portion around the base of the thumb portion of the athletic glove 1 through the tapes 4 and the aforementioned connected portions. Also in this case, the athletic glove 1 can conceivably supply proper fastening force to the little finger, the ring finger and the middle finger of the user's hand when the user grasps an object.

(Sixth Embodiment)

Figure 6:
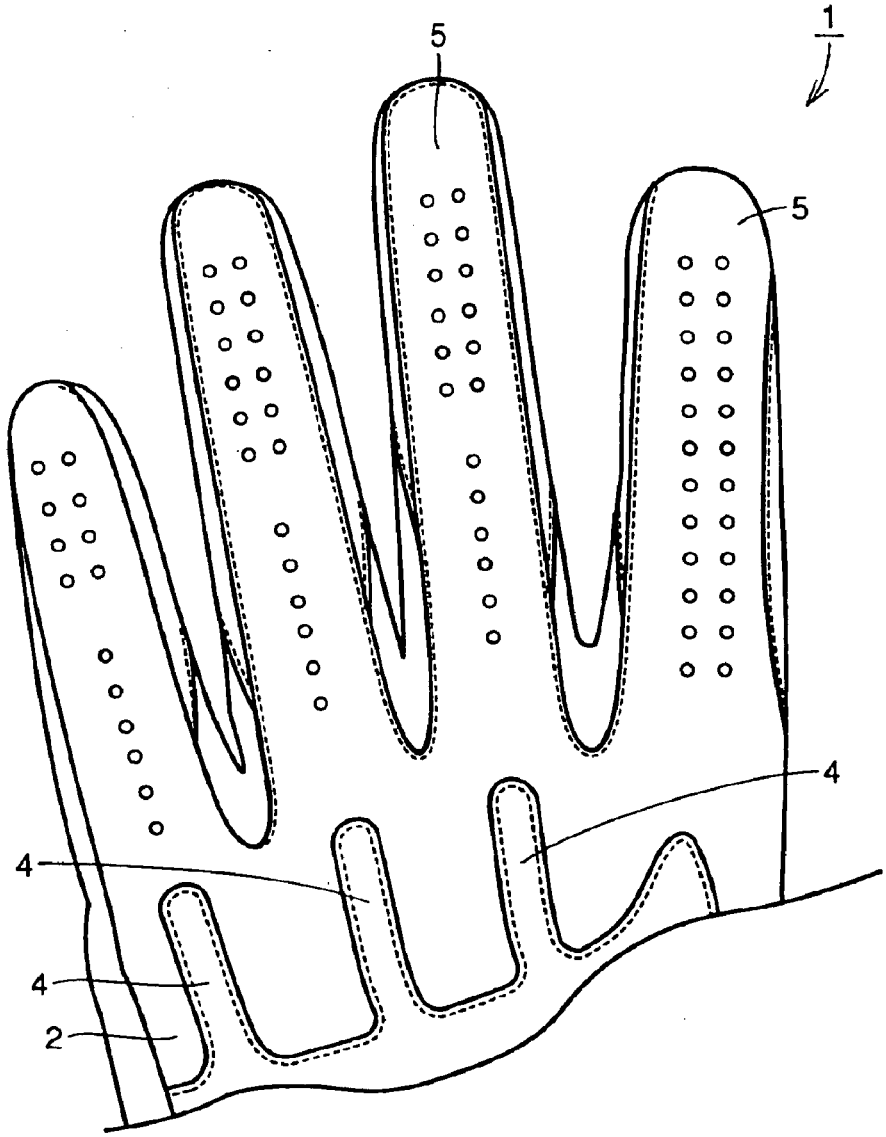

A sixth embodiment of the present invention is now described with reference to FIG. 6. FIG. 6 illustrates an athletic glove 1 according to the sixth embodiment of the present invention as viewed from the side for covering the back of the user's hand.

According to this embodiment, tapes 4 are provided on portions covering the metacarpophalangeal joint 12 of at least one of the little finger, the ring finger and the middle finger of the user's hand. In the embodiment shown in FIG. 6, the tapes 4 are stitched to portions covering the metacarpophalangeal joints 12 of the little finger, the ring finger and the middle finger.

One ends of the tapes 4 are connected with each other as shown in FIG. 6, and the connected portions are connected with a portion around the base of a thumb portion. Therefore, a little finger portion, a ring finger portion and a middle finger portion of a back portion 2 are connected with the portion around the base of the thumb portion of the athletic glove 1 through the tapes 4 and the aforementioned connected portions, similarly to the case of the fifth embodiment.

Also in the sixth embodiment, the athletic glove 1 can conceivably supply proper fastening force to the little finger, the ring finger and the middle finger of the user's hand when the user grasps an object.

(Seventh Embodiment)

Figure 7:
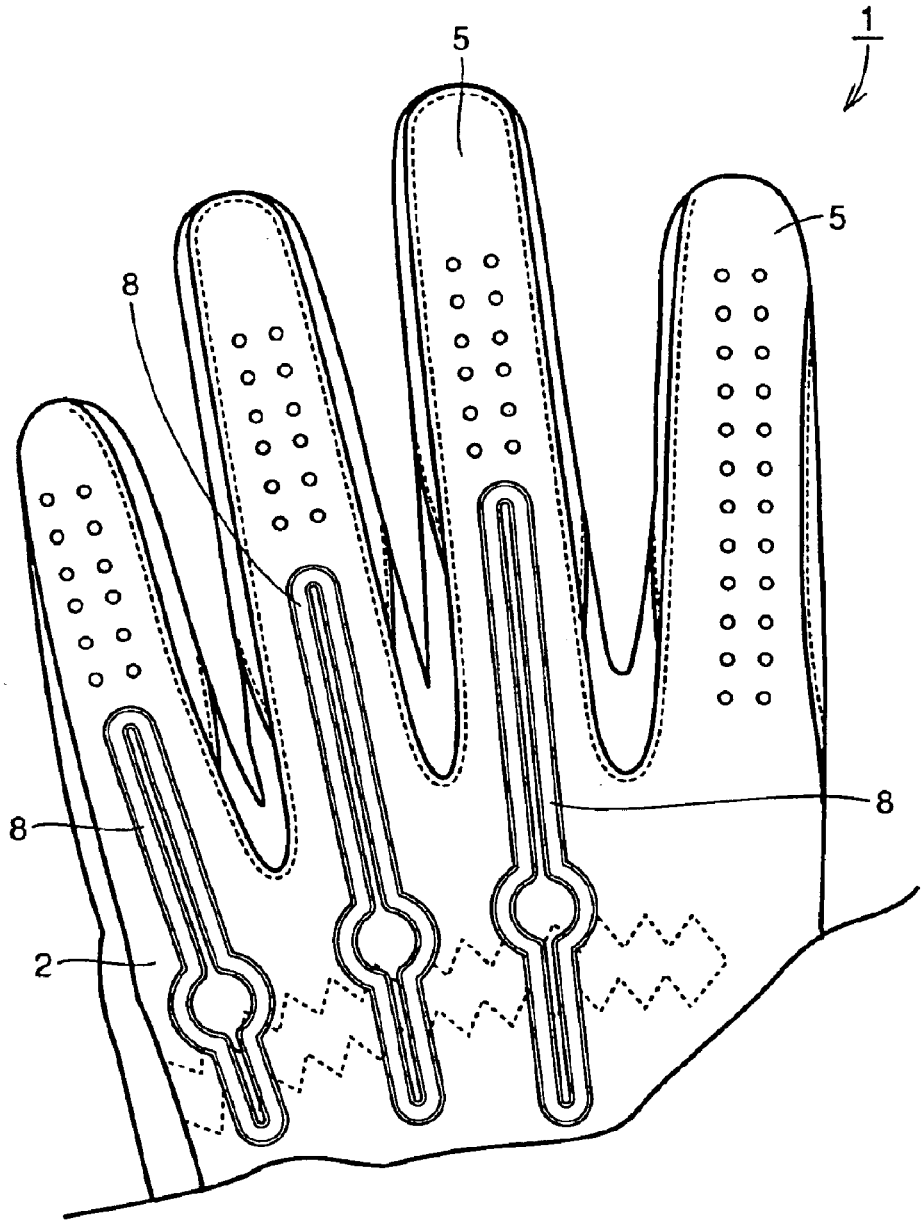

A seventh embodiment of the present invention is now described with reference to FIG. 7. FIG. 7 illustrates an athletic glove 1 according to the seventh embodiment of the present invention as viewed from the side for covering the back of the user's hand.

According to this embodiment, resin portions 8 are provided on portions covering a region around the second interphalangeal joint 12 of at least one of the little finger, the ring finger and the middle finger of the user's hand and the metacarpal bone 11 of each finger. In the embodiment shown in FIG. 7, the resin portions 8 are provided on portions covering regions around the second interphalangeal joints 12 of the little finger, the ring finger and the middle finger and the metacarpal bones 11 of the fingers. The resin portions 8 are stitched, bonded, thermocompression-bonded or heat-sealed to a back portion 2.

Also in this case, the athletic glove 1 can conceivably supply proper fastening force to the little finger, the ring finger and the middle finger of the user's hand when the user grasps an object.

While each of the aforementioned embodiments has been described mainly with reference to a baseball or golf glove, the present invention may be applied to a glove employed in a sport other than the above so far as the glove is employed for grasping an object such as a sphere or a rod.

According to the present invention, the user can firmly grasp an object with the little finger, the ring finger and the middle finger rather than with the thumb or the index finger and concentrate his attention on the little finger, the ring finger and the middle finger when grasping the object. Thus, he can grasp the object in a relaxed state with no extra power, and the ratio of grasping power with the little finger, the ring finger and the middle finger to that with the overall palm of the hand can be increased. Consequently, the user's ability can be improved as compared with an empty-handed state or a state wearing a general glove.

The athletic glove can also inhibit the palm portion from slackening or creasing, whereby fittingness to the user's hand is so improved that the user can grasp the object as imaged for making a subtle and delicate motion.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An athletic glove comprising a back portion covering the back of the user's hand and worn for grasping an object, wherein said back portion having a little finger portion, a ring finger portion and a middle finger portion, said back portion provided with a tape portion having a general length extending along a direction from the proximal phalanx of at least one of the little finger, the ring finger and the middle finger of the user's hand toward the metacarpal bone of the index finger of the user's hand, said tape portion having a width throughout the length of said tape portion which is narrower than said finger portions of the glove.

2. The athletic glove according to claim 1, wherein said tape portion is constructed of a material having a higher elasticity than said little finger portion, said ring finger portion or said middle finger portion of said back portion.

3. The athletic glove according to claim 1, wherein said tape portion includes a plurality of tape segments, a respective of said tape segments extending along a direction from the proximal phalanxes of the little finger, the ring finger and the middle finger of the user's hand toward the metacarpal bone of the index finger of the user's hand.

4. The athletic glove according to claim 1, wherein said tape portion curvedly extends from the vicinity of the metacarpophalangeal joints of the little finger, the ring finger and the middle finger of the user's hand toward the metacarpal bone of the thumb of the user's hand.

5. The athletic glove according to claim 1, wherein said tape portion extends downwardly in a curved path from said finger portion along a direction from the proximal phalanx of at least one of the little finger, the ring finger and the middle finger of the user's hand toward the metacarpal bone of the index finger of the user's hand.

6. An athletic glove comprising a back portion covering the back of the user's hand and worn for grasping an object, wherein said back portion having a little finger portion, a ring finger portion and a middle finger portion, said back portion provided with at least a first and second tape portion having general lengths extending along a direction from the proximal phalanx of at least one of the little finger, the ring finger and the middle finger of the user's hand respectively toward the metacarpal bone of the index finger of the user's hand, each of said tape portions having a width throughout the length of said tape portion which is narrower than said finger portions of the glove.

7. The athletic glove according to claim 6 wherein, each of said tape portions are offset from one another.

8. The athletic glove according to claim 6, wherein said tape portions are constructed of a material having a higher elasticity than said little finger portion, said ring finger portion, or said middle finger portion of said back portion.

9. The athletic glove according to claim 6, wherein said tape portions extend along a direction from the proximal phalanxes of the little finger, the ring finger and the middle finger of the user's hand toward the metacarpal bone of the index finger of the user's hand.

10. The athletic glove according to claim 6, wherein said tape portions curvedly extend from the vicinity of the metacarpophalangeal joints of the little finger, the ring finger and the middle finger of the user's hand toward the metacarpal bone of the thumb of the user's hand.

* * * * *